US007527212B2

(12) United States Patent
Kitaguchi

(10) Patent No.: US 7,527,212 B2
(45) Date of Patent: May 5, 2009

(54) CRUSHER

(75) Inventor: Atsushi Kitaguchi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 11/582,531

(22) Filed: Oct. 18, 2006

(65) Prior Publication Data

US 2007/0102549 A1 May 10, 2007

(30) Foreign Application Priority Data

Nov. 7, 2005 (JP) ..... 2005-322865

(51) Int. Cl.
*B02C 13/286* (2006.01)

(52) U.S. Cl. ..... 241/186.35; 241/223

(58) Field of Classification Search ..... 241/186.35, 241/223, 189.1

See application file for complete search history.

(56) References Cited

U.S. PATENT DOCUMENTS 2,954,176 A * 9/1960 Cole ..... 241/186.3
3,701,483 A * 10/1972 Crosby et al. ..... 241/32
5,657,933 A * 8/1997 Williams ..... 241/186.3
5,947,395 A 9/1999 Peterson et al.
6,742,732 B1 * 6/2004 Hundt et al. ..... 241/28

* cited by examiner

*Primary Examiner*—Mark Rosenbaum
(74) *Attorney, Agent, or Firm*—Mattingly & Malur, P.C.

(57) ABSTRACT

A crusher comprises a crushing apparatus including a crushing rotor provided with a crushing bit for crushing target materials, a feed conveyor for conveying the target materials to the crushing apparatus, a pressing roller for pressing the target materials conveyed on the feed conveyor and introducing the target materials to the crushing apparatus in cooperation with the feed conveyor, and hydraulic cylinders for changing a relative positional relationship between the crushing apparatus and the feed conveyor, to thereby change a crushing angle formed between a feed direction of the target materials when the target materials are introduced to the crushing apparatus and a line tangential to the crushing rotor at a position where the crushing bit hits against the target materials. Since an angle at which the crushing bit cuts into the target materials is adjustable, crushed chips can be produced in a way flexibly adapted for various needs caused in sites by using a single crusher.

5 Claims, 8 Drawing Sheets

CRUSHER

BACKGROUND OF THE INVENTION

1. Field of the Invention

The present invention relates to a crusher capable of crushing target materials to be crushed.

2. Description of the Related Art

Crushers are used to crush various target materials for the purposes of primarily reusing wastes and reducing the volume of wastes. Among those crushers, there is a crusher for primarily crushing pruned branches, lumber from thinning, etc. which are generated, for example, when making woodlands to order and when maintaining and managing forests, limb and twig cuttings which are generated when cutting trees in forests and pruning the trees, as well as scrap wood generated when dismantling wooden houses One example of that type of crusher is known as a horizontally-loading crusher in which target materials pressed on a feed conveyor by a pressing roller are introduced to a crushing apparatus with cooperation of the feed conveyor and the pressing roller, and the introduced target materials are crushed by a crushing rotor which is operated at high speed (see U.S. Pat. No. 5,947,395).

SUMMARY OF THE INVENTION

Recently, applications or needs of such a crusher have been increased in more various fields. In some cases, crushing efficiency has priority over the grain size of chips produced after the crushing (i.e., crushed chips), and in other cases, more importance is paid to the grain size of the crushed chips. In the above-mentioned type of crusher, however, the positional relationship between the feed conveyor and the pressing roller is held fixed such that crushing bits provided on the crushing rotor always cut the target materials introduced to the crushing apparatus substantially at a constant angle for crushing them. For that reason, it is hard to widely change the crushing efficiency and the grain size of the crushed chips. In other words, there is a difficulty in meeting various needs by a single crusher.

An object of the present invention is to provide a crusher capable of producing crushed chips in a way flexibly adapted for various needs caused in sites by using a single crusher.

To achieve the above object, according to a first aspect, the present invention provides a crusher comprising a crushing apparatus including a crushing rotor provided with a crushing bit for crushing target materials; a feed conveyor for conveying the target materials to the crushing apparatus; a pressing roller for pressing the target materials conveyed on the feed conveyor and introducing the target materials to the crushing apparatus in cooperation with the feed conveyor; and a unit for changing a relative positional relationship between the crushing apparatus and the feed conveyor, to thereby change a crushing angle formed between a feed direction of the target materials when the target materials are introduced to the crushing apparatus and a line tangential to the crushing rotor at a position where the crushing bit hits against the target materials.

According to a second aspect of the present invention, in the crusher according to the first aspect, the unit for changing the relative positional relationship between the crushing apparatus and the feed conveyor is preferably a feed-conveyor height adjusting unit for vertically moving the feed conveyor up and down.

According to a third aspect of the present invention, in the crusher according to the first aspect, the unit for changing the relative positional relationship between the crushing apparatus and the feed conveyor is preferably a feed-conveyor inclination angle adjusting unit for changing a level position of at least one of opposite ends of the feed conveyor in the feed direction of the target materials, thereby adjusting an inclination angle of the feed conveyor.

According to a fourth aspect of the present invention, in the crusher according to the second aspect, the feed conveyor height adjusting unit is preferably constituted by a plurality of cylinders disposed laterally of outer walls of a hopper, into which are loaded the target materials, and supporting bearings of a drive wheel and a driven wheel in a vertically movable manner independently of one another, the drive wheel and the driven wheel being disposed at opposite ends of the feed conveyor in the feed direction of the target materials.

According to a fifth aspect of the present invention, in the crusher according to the third aspect, the feed conveyor inclination angle adjusting unit is preferably constituted by a plurality of cylinders disposed laterally of outer walls of a hopper, into which are loaded the target materials, and supporting bearings of a drive wheel and a driven wheel in a vertically movable manner independently of one another, the drive wheel and the driven wheel being disposed at opposite ends of the feed conveyor in the feed direction of the target materials.

DESCRIPTION OF THE PREFERRED EMBODIMENTS

An embodiment of the present invention will be described below with reference to the drawings.

Figure 1:
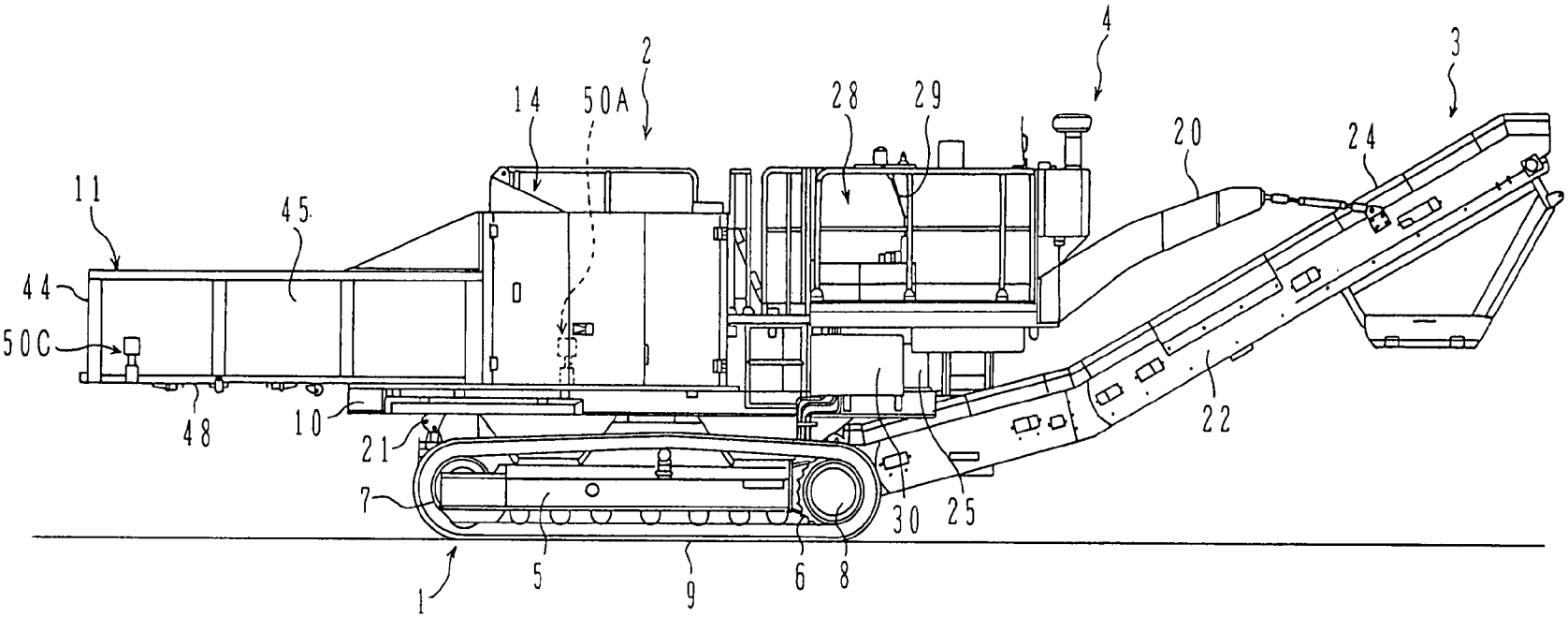
FIG. 1 is a side view of a crusher according to an embodiment of the present invention.
Figure 2:
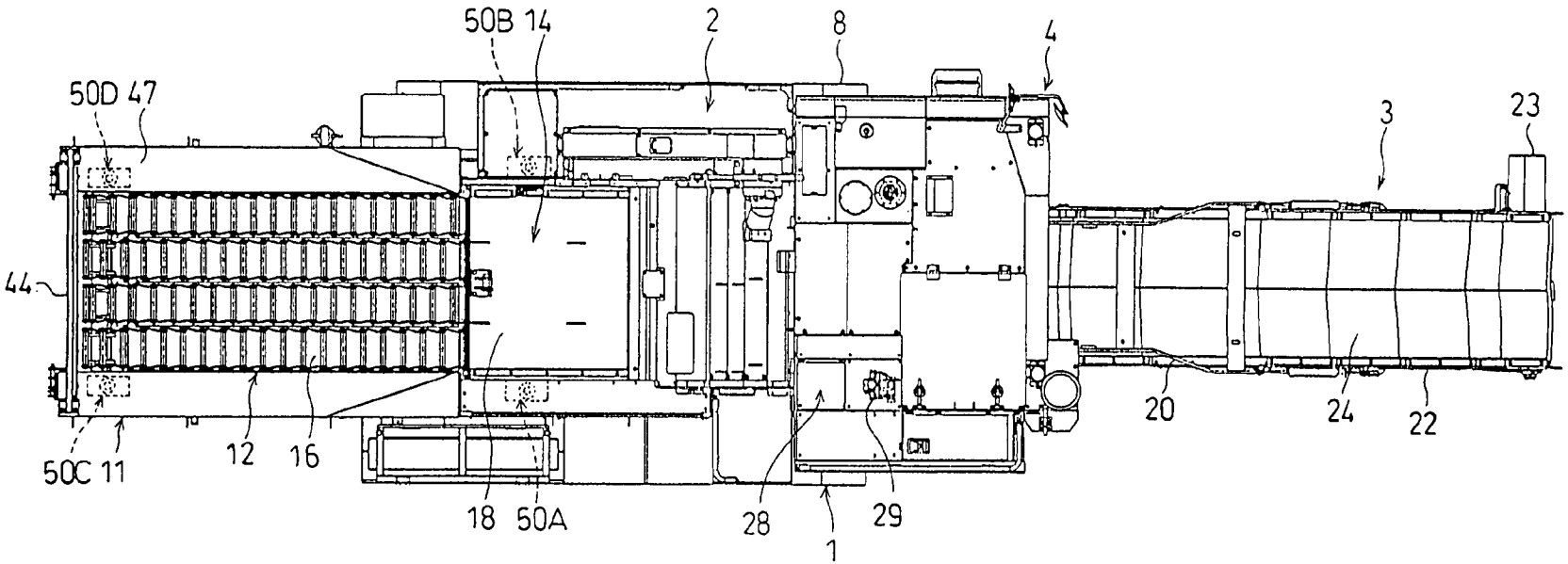
FIG. 2 is a plan view of the crusher according to the embodiment of the present invention.
Figure 3:
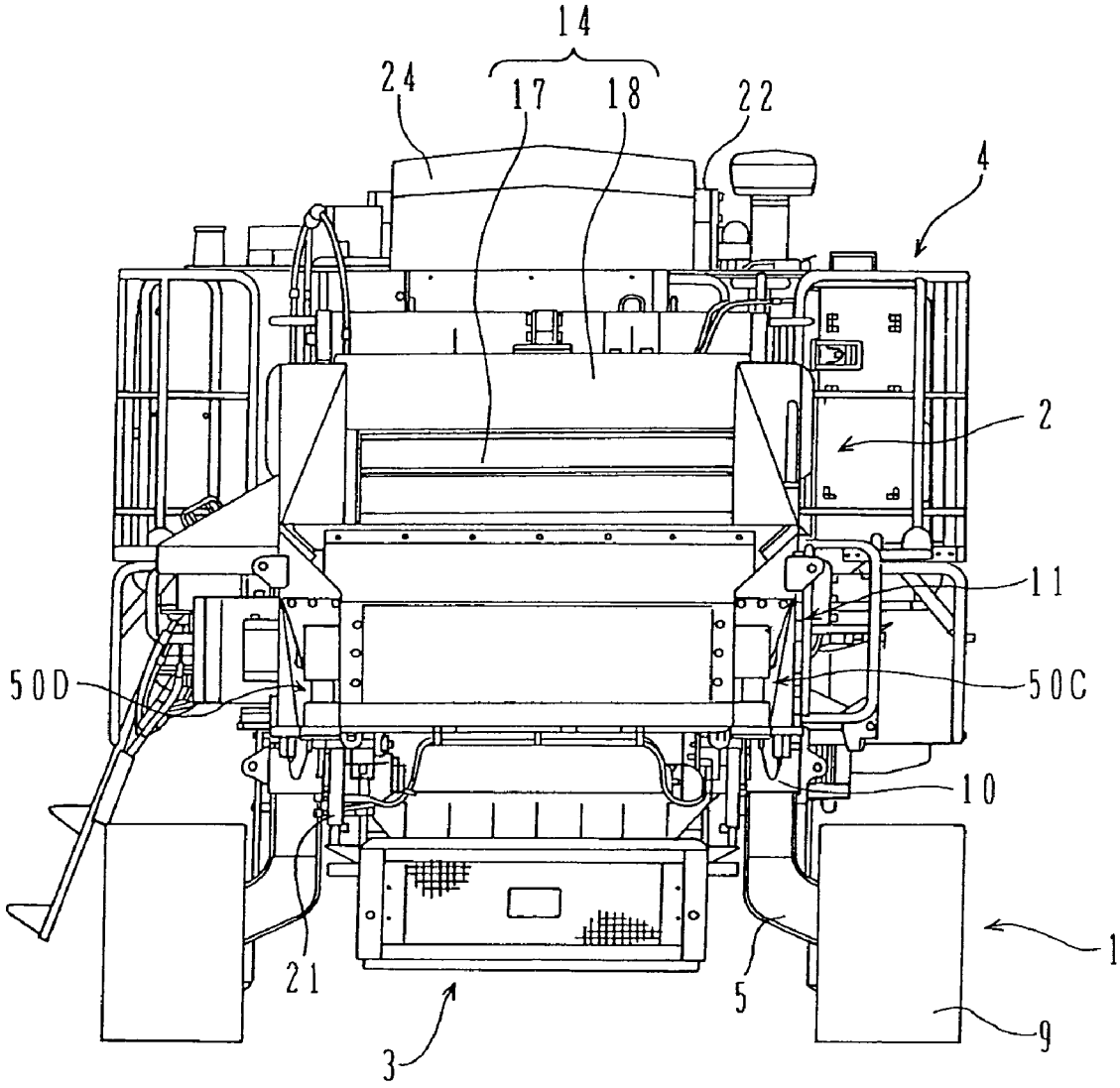
FIG. 3 is a rear view of the crusher according to the embodiment of the present invention.
Figure 4:
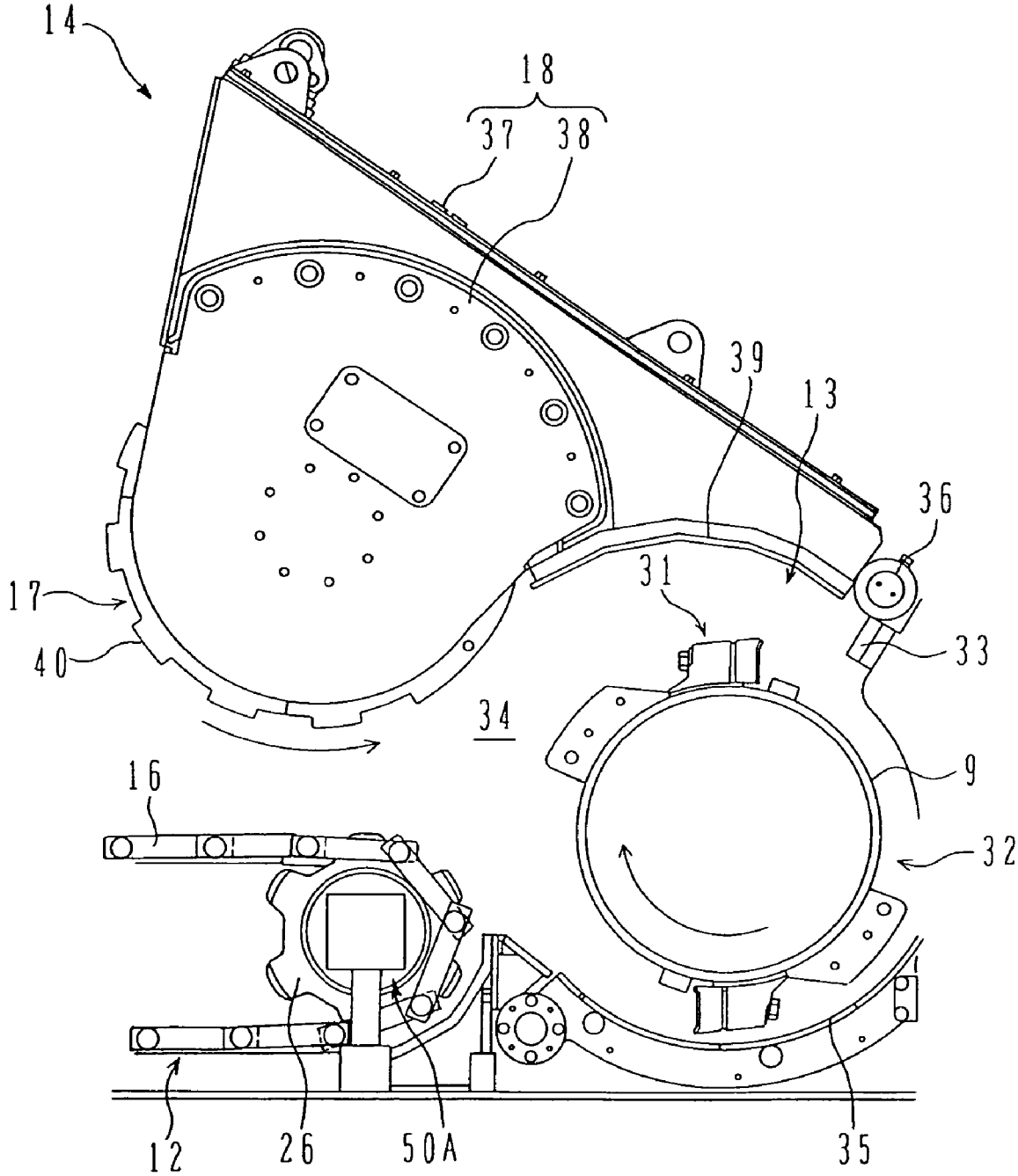
FIG. 4 is a side view showing an inner structure of a crushing apparatus and thereabout, which is installed nearly in a central section of the crusher according to the embodiment of the present invention.

FIG. 1 is a side view showing an overall structure of a crusher according to the embodiment of the present invention. FIG. 2 is a plan view of the crusher, and FIG. 3 is a rear view of the crusher, looking from the rear side. FIG. 4 is a side view showing an inner structure of a crushing apparatus and thereabout, which is installed nearly in a central section of the crusher. Note that, in the drawings, the same components are denoted by the same reference numerals. Also, in the following description, directions corresponding to the left and right in FIG. 1 are assumed to represent the front and rear of the crusher, respectively.

Referring to FIGS. 1-4, a crusher of the embodiment comprises primarily a travel body 1 capable of being self-propelled, a crusher main body 2 installed on the travel body 1, a discharge conveyor 3 which serves as a discharge unit for conveying crushed materials (crushed chips) supplied from the crushing main body 2 and for discharging the crushed chips to the exterior of the crusher, and motive power equipment (power unit) 4 including, e.g., a power source (engine) for driving various operational components mounted in the crusher. Structures of the travel body 1, the crusher main body 2, the discharge conveyor 3, and the power unit 4 will be described below in more detail.

The travel body 1 comprises a track frame 5, a drive wheel 6 and a driven wheel 7 disposed respectively at longitudinal opposite ends of the track frame 5, a driving unit (hydraulic motor for traveling) 8 having an output shaft coupled to a shaft of the drive wheel 6, and a crawler (caterpillar belt) 9 looped over the drive wheel 6 and the driven wheel 7. A body frame 10 is disposed on the track frame 5. The body frame 10 supports the crusher main body 2, the discharge conveyor 3, the power unit 4, etc.

The crusher main body 2 comprises a crushing apparatus 13 (see FIG. 4) for crushing the target materials, a hopper 11 for receiving the crushed materials loaded by a grapple or the like, a feed conveyor 12 for conveying the target materials, which have been loaded into the hopper 11, to the crushing apparatus 13, hydraulic cylinders 50A-50D for adjusting the height (level position) and the inclination angle of a conveying surface of the feed conveyor 12, and a pressing roller device 14 for pressing the target materials conveyed by the feed conveyor 12 from above, thereby introducing the target materials into the crushing apparatus 13 in cooperation with the feed conveyor 12.

The hopper 11 is in the bottom-equipped form with its top portion opened and is arranged so as to surround the feed conveyor 12 and to extend substantially horizontally on the side rearward of a crushing rotor 32 (see FIG. 4) which is installed on the body frame 10. The hopper 11 comprises a rear wall 44 disposed behind the feed conveyor 12, outer walls 45 disposed on both sides of the feed conveyor 12 in the transverse direction thereof, side walls (not shown) disposed inside the outer walls 45 on both sides of the feed conveyor 12 in the transverse direction thereof and having upper ends positioned slightly above the conveying surface of the feed conveyor 12, a spreading (flaring) portion 47 provided above the side walls and the outer walls 45 so as to straddle between them and to gradually spread upward, and a bottom wall 48 disposed below the feed conveyor 12 with a slight gap left relative to the feed conveyor 12.

The feed conveyor 12 comprises a sprocket-like drive wheel 26 disposed in the rear side of the body frame 10 in the longitudinal direction thereof such that the drive wheel 26 is included in the hopper 11 and is positioned to face the crushing rotor 32 (described later) provided in the crushing apparatus 13, a driven wheel 27 (see FIG. 5 described later) disposed in the rear side of the crusher, and a running member 16 looped between the drive wheel 26 and the driven wheel 27. An output shaft of a driving unit (not shown) for driving the feed conveyor 12 is coupled to a drive shaft (not shown) which serves as a rotary shaft of the drive wheel 26, whereby a driving force of the driving unit is transmitted to the drive wheel 26. The running member 16 is constituted by a chain belt and is disposed in plural rows (four in this embodiment) side by side in the transverse direction of the crusher, as shown in FIG. 2. Alternatively, the running member 16 may be constituted by rubber belts, for example. Note that, in the following description, a rotary shaft (not shown) of the driven wheel 27 is called a driven shaft, as required.

The hydraulic cylinder 50A is positioned on the right side laterally of the feed conveyor 12 in its front portion and supports one end of the drive shaft of the drive wheel 26 in a vertically movable manner. The hydraulic cylinder 50B is positioned on the lateral side opposed to the hydraulic cylinder 50A (i.e., on the left side laterally of the feed conveyor 12 in its front portion) and supports the other end of the drive shaft of the drive wheel 26 in a vertically movable manner. Further, the hydraulic cylinder 50C is positioned on the right side laterally of the feed conveyor 12 in its rear portion and supports one end of the driven shaft of the driven wheel 27 in a vertically movable manner. The hydraulic cylinder 50D is positioned on the lateral side opposed to the hydraulic cylinder 50C (i.e., on the left side laterally of the feed conveyor 12 in its rear portion) and supports the other end of the driven shaft of the driven wheel 27 in a vertically movable manner.

The pressing roller unit 14 is disposed so as to cover an upper portion of the crushing apparatus 13. The pressing roller unit 14 comprises a pressing roller 17 disposed above the drive wheel 26 of the feed conveyor 12 in opposite relation, and a support member 18 for supporting the pressing roller 17. A front end of the support member 18 is mounted to a rotary shaft 36 in a vertically rotatable manner with the rotary shaft 36 serving as a fulcrum such that the pressing roller 17 is movable up and down. The rotary shaft 36 is rotatably supported, though not shown in FIG. 4, through a bearing to a side wall of a housing (not shown) which covers the crushing apparatus 13, etc.

The support member 18 comprises an arm portion 37 including the rotary shaft 36 provided at its base end, and a bracket portion 38 mounted to the distal end side (i.e., the side opposed to the base end) of the arm portion 37. The pressing roller 17 is rotatably supported by the bracket portion 38 constituting the support member 18. A curved plate 39 defining a part of a crushing chamber 34 is attached to a lower surface of the arm portion 37 which is positioned to face the crushing chamber 34. Though not specifically shown, the pressing roller 17 is constituted by a hollow drum-like member and includes a driving unit (not shown) mounted within a drum. The pressing roller 17 is rotated by the driving unit to roll in the direction in which the target materials are conveyed by the feed conveyor 12 (i.e., counterclockwise in FIG. 4), substantially at the same circumferential speed as the conveying speed of the target materials. Additionally, a portion shown in FIG. 4 as projecting from the bracket portion 38 of the pressing roller 17 represents a cover 40 provided at an end surface of the pressing roller 17.

The crushing apparatus 13 is mounted within the crusher body substantially on a central portion of the body frame 10 in the longitudinal direction and is positioned to face the front end of the feed conveyor 12. The crushing apparatus 13 includes the crushing rotor 32 provided with a plurality of crushing bits 31 mounted to a circumferential barrel portion (outer peripheral portion) of a drum 19. By rotating the crushing rotor 32 at a high speed, the crushing bits 31 hit against the target materials introduced by the feed conveyor 12 for roughly crushing the target materials. The roughly crushed pieces of the target materials are bumped against an anvil (bump plate) 33 and finely crushed by the action of impact forces. During the crushing process, the crushed materials are further crushed into finer grains while repeatedly moving around in the crushing chamber 34 with the rotation of the crushing rotor 32 and striking against the crushing bits 31, the anvil 33, etc. The crushed materials having grain sizes smaller than the mesh (opening) size of a screen 35, which constitutes a part of a wall surface defining the crushing chamber 34, pass through the screen 35 to be expelled out on the discharge conveyor 3.

A portion of the discharge conveyor 3 on the discharge side (i.e., the front side) is supported by a support member 20 projecting from the power unit 4. Also, another portion of the discharge conveyor 3 on the opposite side (i.e., the rear side) is supported through a support member 21 in a state suspended from the body frame 10. Thus, the discharge conveyor 3 is disposed so as to extend under the crushing apparatus 13 and the power unit 4, and to further extend externally forward of the crusher body while inclining upward. A drive wheel and a driven wheel (both not shown) are rotatably provided at front and rear ends of a frame 22 of the discharge conveyor 3 in the longitudinal direction thereof, and a conveyor belt (not shown) is looped between the drive wheel and the driven wheel. A driving unit (hydraulic motor for the discharge conveyor) 23 is directly coupled to a rotary shaft of the drive wheel located on the front side. By rotating the driving unit 23, the conveyor belt is driven to circulate between the drive wheel and the driven wheel. The conveyor belt is covered from above by a cover 24 which is fixed to the conveyor frame 22 to prevent the crushed materials on the conveyor belt from being scattered by, e.g., wind.

The power unit 4 is mounted on a front end portion of the body frame 10 in the longitudinal direction thereof through a support member 25 and is positioned forward of the crushing apparatus 13. The power unit 4 includes an engine, a hydraulic pump driven by the engine, control valves for controlling flow of a hydraulic fluid from the hydraulic pump to various operating devices, reservoirs for storing fuel and working oil (hydraulic fluid), a radiator for cooling an engine coolant, an air cleaner, and so on.

Behind the power unit 4, a cab 28 is provided in a right side area of the machine body (on the lower side as viewed in FIG. 2). A control lever 29 for travel operation, etc. are disposed in the cab 28. On the other hand, a console 30 used for performing other operations, setting, monitoring, etc. is disposed on the lateral side of the crusher body below the cab 28. While in the embodiment the console 30 is disposed on the lateral side of the crusher body so that an operator can easily operate the console while standing on the ground, it may be disposed in the cab 28.

Detailed construction of the hydraulic cylinders 50A-50D will be described below with reference to FIG. 5.

Figure 5:
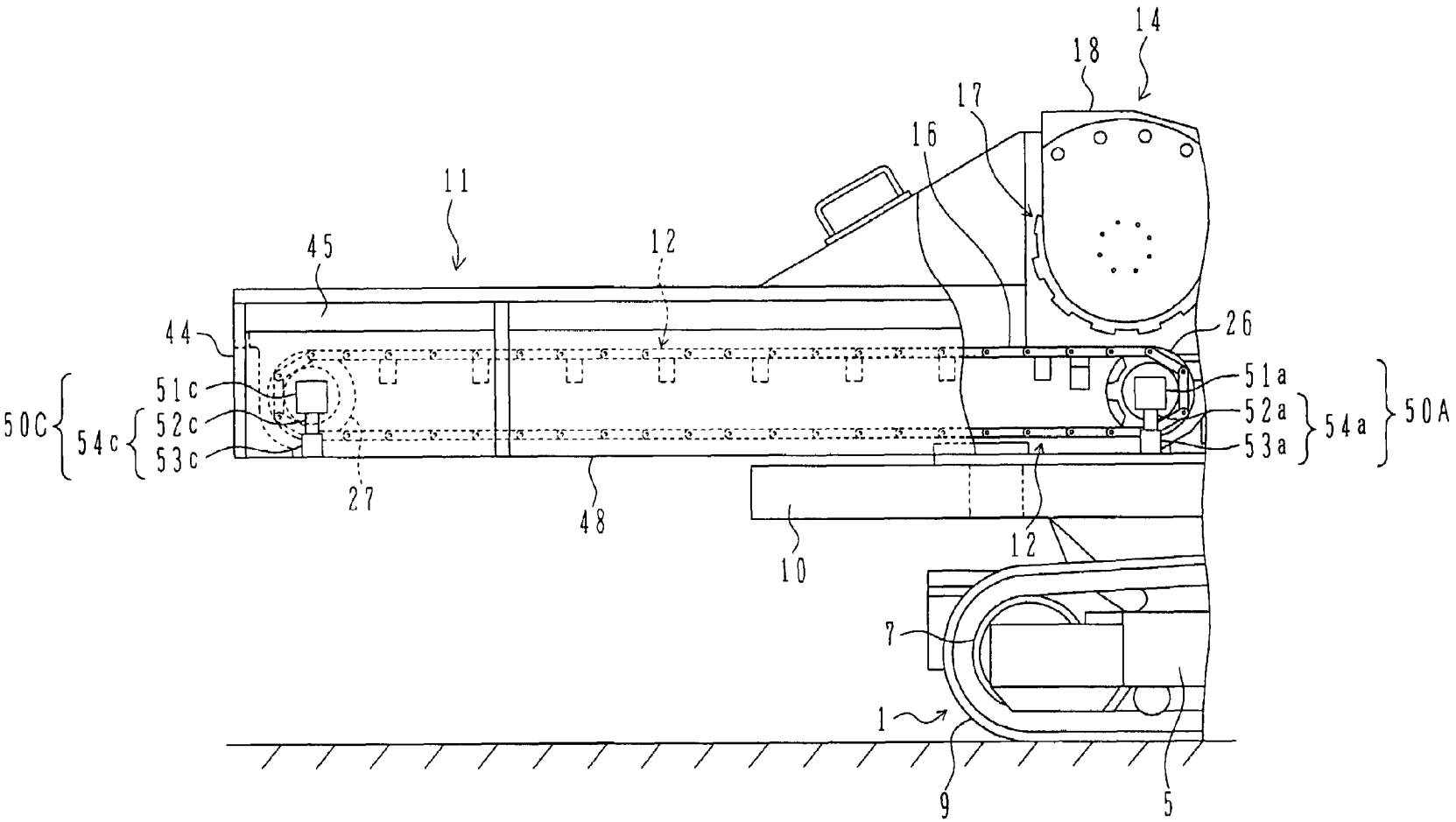
FIG. 5 is a side view of a feed conveyor and thereabout in the crusher according to the embodiment of the present invention.

FIG. 5 is a side view of the feed conveyor 12 and thereabout in the crusher according to the embodiment of the present invention. In FIG. 5, a portion near the drive wheel 26 is partially shown as a sectional view for easier understanding of an inner structure of the crusher. The same components as those in FIGS. 1-4 are denoted by the same reference numerals and a description of those components is omitted here.

Referring to FIG. 5, the hydraulic cylinder 50A is disposed laterally of the outer wall 45 of the hopper 11, and it comprises a bearing portion 51*a* for supporting one end of the drive shaft through which motive power is transmitted to the drive wheel 26, and a cylinder portion 54*a* for supporting the bearing portion 51*a* in a vertically movable manner. The cylinder portion 54*a* is made up of a cylinder tube 53*a* fixed onto the bottom wall 48 of the hopper 11, and a piston rod 52*a* inserted in the cylinder tube 53*a* and having an upper end which is projected from the cylinder tube 53*a* and is connected to the bottom of the bearing portion 51*a*. The piston rod 52*a* is caused to slide in the cylinder tube 53*a* by a force of the hydraulic fluid under pressure toward and away from the cylinder tube 53*a*. With the sliding of the piston rod 52*a*, the hydraulic cylinder 50A is extended or retracted, whereupon the bearing portion 51*a* is moved up and down relative to the bottom wall 48. Each of the other hydraulic cylinders 50B, 50C and 50D also has substantially the same construction as the hydraulic cylinder 50A. Corresponding members are denoted by adding respective suffixes "b", "c" and "d", instead of "a", to the same numerals, and a description of those members are omitted here. The hydraulic cylinders 50A-50D are extended or retracted independently of one another to move the drive shaft and the driven shaft, thus enabling the conveying surface of the feed conveyor 12 to be adjusted in level position and inclination angle by vertical movements of the hydraulic cylinders.

In at least one of a set of the hydraulic cylinders 50A and 50B supporting the drive wheel 26 of the feed conveyor 12 and a set of the hydraulic cylinders 50C and 50D supporting the driven wheel 27, the piston rod 52 and the cylinder tube 53 are preferably coupled through brackets, for example, such that they are swingable relative to the bearing portion 51 and the bottom portion 48 in the longitudinal direction.

The above-described driving unit (not shown) for driving the feed conveyor 12 is fixed to, e.g., the bearing portion 51*a* (or the bearing portion 51*b*) to be able to follow the vertical movement of the drive wheel 26, and the output shaft of the driving unit is coupled through, e.g., a coupling to the drive shaft end of the drive wheel 26, which is projected from the bearing portion 51*a* (or the bearing portion 51*b*). As a modification, a driving transmission mechanism may be constituted such that the driving unit is fixed to any of a housing surrounding the crushing apparatus 13, the hopper 11, the body frame 10, etc., and the output shaft of the driving unit and the drive shaft are coupled by a chain through a gear disposed at the drive shaft end of the drive wheel 26. In such a driving transmission mechanism, a pulley and a flexible belt may also be used instead of the gear and the chain.

The basic operation of the crusher according to this embodiment will be described below.

When target materials to be crushed are loaded into the hopper 11 by using a grapple, for example, the target materials are dropped onto the feed conveyor 12 and are conveyed toward the front side of the crusher with movement of the running member 16. When the target materials are conveyed to a position near the pressing roller unit 14, the pressing roller 17 rides over the target materials, whereby the target materials on the feed conveyor 12 are pressed against the feed conveyor 12 by the dead weight of the pressing roller unit 14 and are introduced to the crushing chamber 34 in a state gripped between the feed conveyor 12 and the pressing roller 17. In other words, the target materials are introduced to the crushing apparatus 13 including the crushing rotor 32 while the target materials are projected into the crushing chamber 34 in the cantilevered form with their proximal ends gripped between the pressing roller 17 and the feed conveyor 12.

The target materials introduced to the crushing apparatus 13 are cut and roughly crushed by the crushing bits 31 at an angle (referred to as a "crushing angle" described in detail later) formed by the feed direction of the target materials into the crushing apparatus 13 and a line tangential to the crushing rotor 32 at a position where each crushing bit 31 hits against the target materials. The roughly crushed target materials are forced to move around within the crushing chamber 34 with the rotation of the crushing rotor 32 while bumping against the crushing bits 31, the anvil 33, etc. for finer crushing. When the target materials are repeatedly crushed and crushed pieces are further smashed to have such a grain size as being able to pass through the screen 35, the crushed materials (crushed chips) are expelled out onto a conveyor belt of the discharge conveyor 3 after passing through the screen 35. The expelled-out crushed materials are conveyed by the conveyor belt of the discharge conveyor 3 toward the front side of the crusher and are discharged externally of the crusher.

Thus, the target materials are subjected to the crushing process in which the target materials are crushed within the crushing chamber 34 and the crushed materials are discharged externally of the crusher through the conveyor belt of the discharge conveyor 3. The inventors attained the following finding with regard to the relationship between the crushing angle and production results of the crushed materials in the stage of rough crushing during the crushing process.

More specifically, the inventors found that the throughput and the grain size of the crushed chips after the crushing process were changed depending on the change of the crushing angle. In other words, there is a tendency that, taking as a basis the case of the crushing angle being a right angle, production efficiency of the crushed chips is increased in the case of the crushing angle being an acute angle due to the relationship between the crushing angle and the grain of wood, which is one factor, and the grain size of the crushed chips is reduced in the case of the crushing angle being an obtuse angle.

Based on that finding, in the crusher of this embodiment, the hydraulic cylinders 50A-50D are provided, as described above, such that the crushing angle can be adjusted in consideration of the desired crushing efficiency, the grain size of the crushed chips, etc. by changing the relative positional relationship between the feed conveyor 12 and the crushing apparatus 13. In this embodiment, the following two methods are used to adjust the crushing angle by the hydraulic cylinders 50A-50D;

(1) method of changing the height of the conveying surface of the feed conveyor 12, and (2) method of changing the inclination of the conveying surface of the feed conveyor 12.

Those two methods will be described below.

(1) Method of Changing the Height of the Conveying Surface of the Feed Conveyor 12

In this embodiment, the height of the conveying surface of the feed conveyor 12 is changed, by way of example, as follows. An operator manually performs a predetermined operation on the console 30 to extend or retract the hydraulic cylinders 50A-50D until reaching equal heights so that the drive shaft and the driven shaft supported by the hydraulic cylinders 50A-50D have the same height. The height of the running member 16 looped between the drive wheel 26 and the driven wheel 27 is also changed in accordance with change in the height of both the wheels 26 and 27. Therefore, the height of the conveying surface of the feed conveyor 12 can be changed. Further, in order to positively hold the height of the conveying surface of the feed conveyor 12, which has been changed by using the hydraulic cylinders 50A-50D as described above, during subsequent work and so on, the height of both the wheels 26 and 27 is mechanically fixed by using fixing means (not shown), such as spacers or bolts, for supporting, e.g., the bearings of the drive shaft and the driven shaft after the height adjustment. As a result, the adjusted height of the conveying surface of the feed conveyor 12 can be prevented from changing during the work, etc., and more stable crushing work can be ensured. Alternatively, the fixing means may be realized, for example, by providing, at each of appropriate positions in the crusher, a bracket which has a plurality of pin holes spaced from each other in the height direction and which can fix the height of the conveying surface through pin connection by inserting a pin into one of the pin holes corresponding to the adjusted height of the conveying surface, or a bracket which has an elongate hole extending in the height direction and which can fix the height of the conveying surface through bolt connection by fastening a bolt through the elongate holes at the adjusted height.

The relationship between the height of the conveying surface of the feed conveyor 12 and the crushing angle will be described below with reference to FIGS. 6-8.

Figure 6:
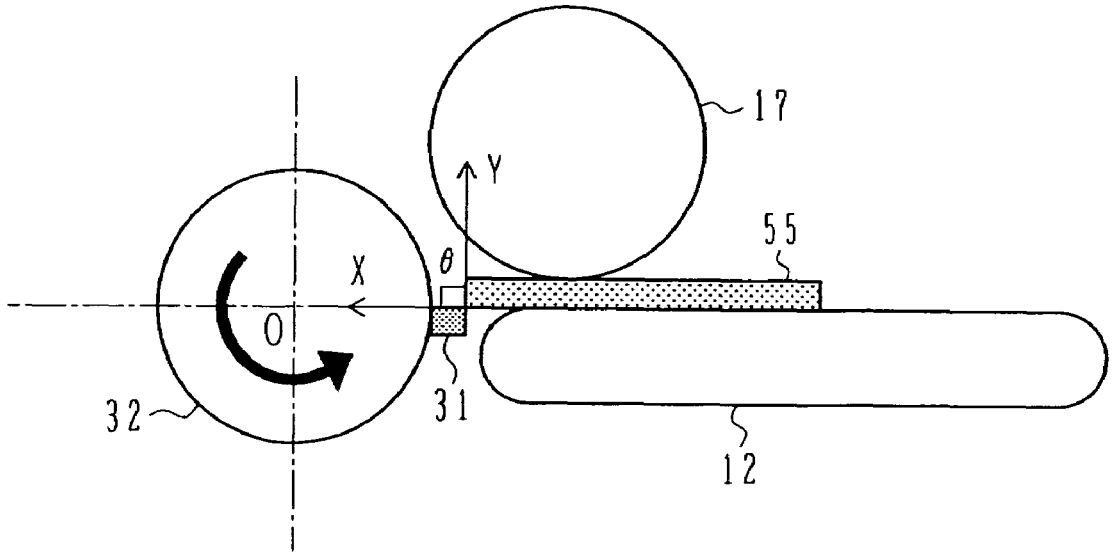
FIG. 6 is an illustration for explaining the principle of the present invention when the height of a conveying surface of the feed conveyor is adjusted such that a crushing angle is a right angle.
Figure 7:
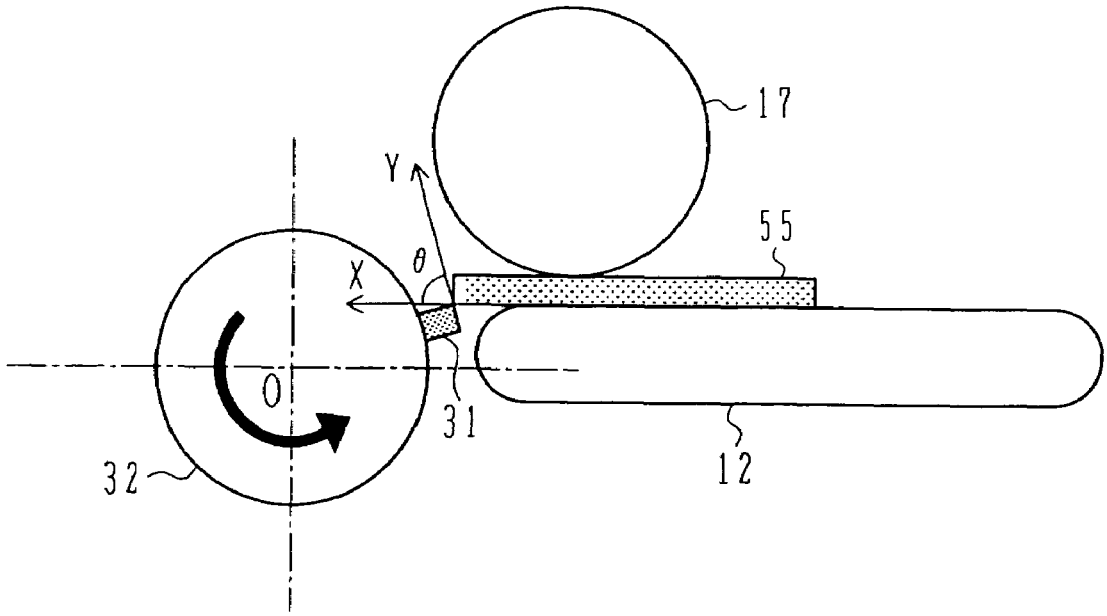
FIG. 7 is an illustration for explaining the principle of the present invention when the height of the conveying surface of the feed conveyor is adjusted such that the crushing angle is an acute angle.
Figure 8:
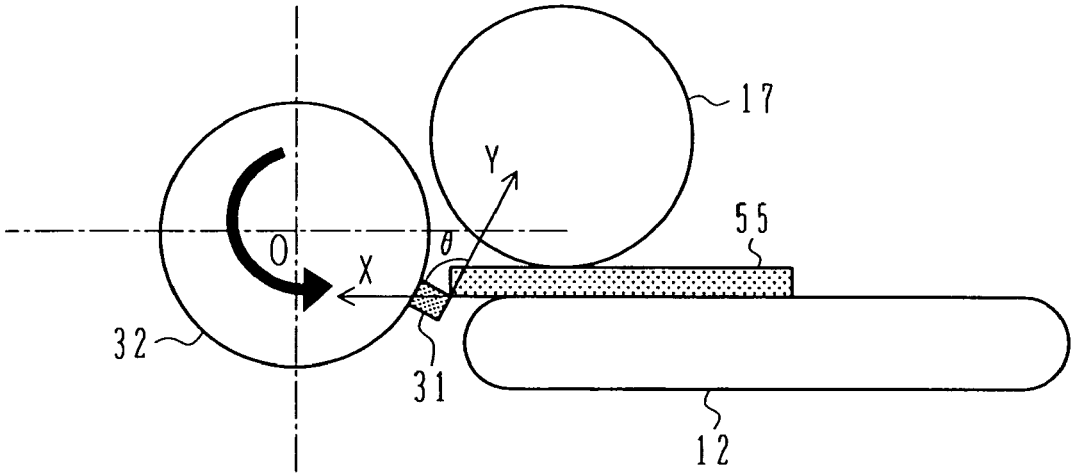
FIG. 8 is an illustration for explaining the principle of the present invention when the height of the conveying surface of the feed conveyor is adjusted such that the crushing angle is an obtuse angle.

FIGS. 6-8 are illustrations for explaining the principles of the present invention. FIG. 6 illustrates a state where the height of the conveying surface of the feed conveyor is changed to adjust the crushing angle into a right angle. FIG. 7 illustrates a state where the crushing angle is adjusted into an acute angle through the height adjustment, and FIG. 8 illustrates a state where the crushing angle is adjusted to an obtuse angle through the height adjustment. The same components as those in FIGS. 1-5 are denoted by the same reference numerals and a description of those components is omitted here.

In FIGS. 6-8, the center of rotation of the crushing rotor 32 is assumed to be O. The crushing rotor 32 is rotated at high speed in the direction of an arrow in the drawing (i.e., counterclockwise) about the rotation center O. Also, it is assumed that the feed direction of a target material (e.g., wood material) 55 introduced to the crushing apparatus 13 is X, a line tangential to the crushing rotor 32 at the hit position where the crushing bit 31 hits against the target material 55 is Y, and the angle formed by the feed direction X of the target material 55 and the tangential line Y to the crushing rotor 32 is a crushing angle θ.

With reference to FIG. 6, a description is first made of the case where the crushing angle θ is a right angle.

As shown in FIG. 6, the height of the conveying surface is set equal to the height of the center 0 of rotation of the crushing rotor 32 by adjusting respective amounts by which the hydraulic cylinders 50A-50D are extended or retracted. By so adjusting the height of the conveying surface, the crushing angle θ formed by the feed direction X of the target material 55 and the tangential line Y to the crushing rotor 32 becomes a right angle. By crushing the target material in such a state, i.e., at the right crushing angle, with the rotation of the crushing rotor 32, the target material can be crushed in a balanced condition of the throughput and the grain size of the crushed chips.

With reference to FIG. 7, a description is next made of the case where the crushing angle θ is an acute angle.

As shown in FIG. 7, the height of the conveying surface is set higher than the height of the center 0 of rotation of the crushing rotor 32 by adjusting respective amounts by which the hydraulic cylinders 50A-50D are extended or retracted. By so adjusting the height of the conveying surface, the crushing angle θ becomes an acute angle as shown in the drawing. By crushing the target material in such a state, i.e., at the acute crushing angle, with the rotation of the crushing rotor 32, the target material can be more efficiently crushed than the case where the crushing angle θ is a right angle, and the throughput of the crushed chips per unit time can be increased. Further, in this case, a horizontal component of the vector of a crushing force applied to the target material by the crushing bit 31 (in the same direction as Y) is directed toward the crushing chamber (to the left in FIG. 7). Accordingly, a tendency of the crushed chips to be scattered toward the crushing chamber upon crushing of the target material is increased in comparison with the other case. It is hence possible to suppress scattering of the crushed chips to the exterior of the crushing chamber when the target material is crushed.

With reference to FIG. 8, a description is made of the case where the crushing angle θ is an obtuse angle.

As shown in FIG. 8, the height of the conveying surface is set lower than the height of the center O of rotation of the crushing rotor 32 by adjusting respective amounts by which the hydraulic cylinders 50A-50D are extended or retracted. By so adjusting the height of the conveying surface, the crushing angle θ becomes an obtuse angle as shown in the drawing. By crushing the target material in such a state, i.e., at the obtuse crushing angle, with the rotation of the crushing rotor 32, the target material can be crushed into finer chips than the case where the crushing angle is a right angle. As a result, the crushed chips having smaller grain size can be obtained.

Thus, when the conveying surface of the feed conveyor 12 is vertically moved by using the hydraulic cylinders 50A-50D, the crushing angle is changed correspondingly as described with reference to FIGS. 6-8. Therefore, the crushing angle can be adjusted depending on the desired crushing efficiency, the grain size of the crushed chips, etc.

(2) Method of Changing the Inclination of the Conveying Surface of the Feed Conveyor 12

While the method of adjusting the height of the conveying surface has been described above as the method of adjusting the crushing angle, the adjustment of the crushing angle can also be likewise performed by inclining the conveying surface so as to change the positional relationship between the crushing rotor 32 and the feed conveyor 12. The method of adjusting the inclination of the conveying surface will be described below.

In this embodiment, the inclination of the conveying surface of the feed conveyor 12 is changed, by way of example, as follows. The operator manually performs a predetermined operation on the console 30 to extend or retract the hydraulic cylinders 50A and 50B until reaching equal heights, to thereby adjust the height of the drive shaft. Independently of the above operation, the hydraulic cylinders 50C and 50D are extended or retracted until reaching equal heights, to thereby adjust the height of the driven shaft. By properly adjusting the vertical height relationship between the drive shaft and the driven shaft in such a manner, the conveying surface of the feed conveyor 12 can be inclined. Further, in order to positively hold the inclination angle of the conveying surface of the feed conveyor 12, which has been changed by using the hydraulic cylinders 50A-50D as described above, during subsequent work and so on, the heights of the drive shaft and the driven shaft are mechanically fixed by using fixing means (not shown), such as spacers or bolts, for supporting, e.g., the bearings of the drive shaft and the driven shaft after the adjustment of the inclination angle. As a result, the adjusted inclination angle of the conveying surface of the feed conveyor 12 can be prevented from changing during the work, etc., and more stable crushing work can be ensured. As in the case of changing the height of the conveying surface as described above in (1), the fixing means may be of course constituted by a bracket for fixing the inclination angle through pin connection, bolt connection, etc.

The relationship between the inclination of the conveying surface of the feed conveyor 12 and the crushing angle will be described below with reference to FIGS. 9 and 10 along with FIG. 6.

Figure 9:
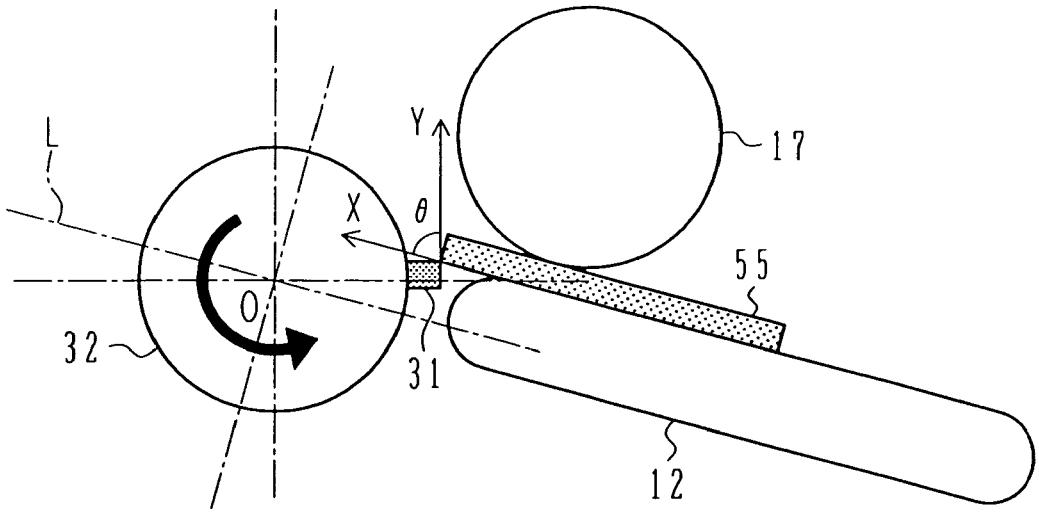
FIG. 9 is an illustration for explaining the principle of the present invention when the inclination of the conveying surface of the feed conveyor is adjusted such that the crushing angle is an acute angle.
Figure 10:
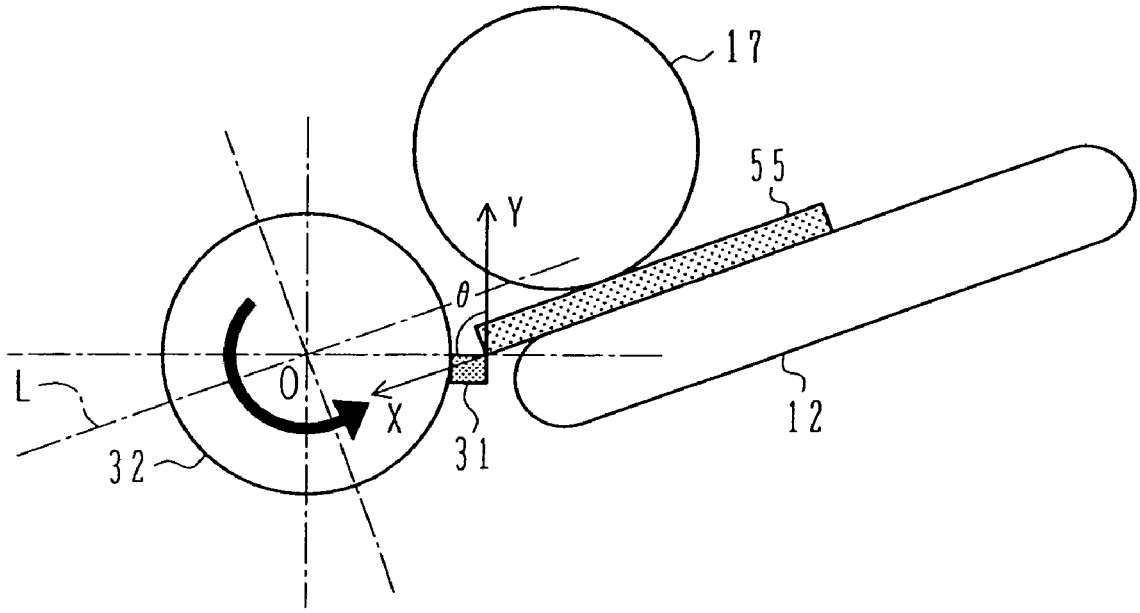
FIG. 10 is an illustration for explaining the principle of the present invention when the inclination of the conveying surface of the feed conveyor is adjusted such that the crushing angle is an obtuse angle.

FIGS. 9 and 10 are illustrations for explaining the principles of the present invention. FIG. 9 illustrates a state where the conveying surface of the feed conveyor is inclined to adjust the crushing angle into an acute angle, and FIG. 10 illustrates a state where the crushing angle is adjusted to an obtuse angle through the inclination adjustment. In FIGS. 9 and 10, a linear line passing the center O of rotation of the crushing rotor 32 and being parallel to the conveying surface of the feed conveyor 12 is assumed to be L. The same components as those in FIGS. 6-8 are denoted by the same reference numerals and a description of those components is omitted here.

With reference to FIG. 9, a description is first made of the case where the crushing angle θ is an acute angle.

As shown in FIG. 9, the level of the inclined conveying surface of the feed conveyor 12 is set higher than the level of the linear line L in the same vertical plane by adjusting respective amounts by which the hydraulic cylinders 50A-50D are extended or retracted. By so inclining the conveying surface, the relative positional relationship between the crushing rotor 32 and the feed conveyor 12 is the same as that in the case shown in FIG. 7. Therefore, the crushing angle θ formed by the feed direction X of the target material 55 and the tangential line Y to the crushing rotor 32 becomes an acute angle. As a result, the target material is crushed in a similar manner to that in the case shown in FIG. 7.

With reference to FIG. 10, a description is next made of the case where the crushing angle θ is an obtuse angle.

As shown in FIG. 10, the level of the inclined conveying surface of the feed conveyor 12 is set lower than the level of the linear line L in the same vertical plane by adjusting respective amounts by which the hydraulic cylinders 50A-50D are extended or retracted. By so inclining the conveying surface, the relative positional relationship between the crushing rotor 32 and the feed conveyor 12 is the same as that in the case shown in FIG. 8. Therefore, the crushing angle θ formed by the feed direction X of the target material 55 and the tangential line Y to the crushing rotor 32 becomes an obtuse angle. As a result, the target material is crushed in a similar manner to that in the case shown in FIG. 8.

Though a detailed description is omitted here for the sake of avoiding redundancy, the crushing angle θ can also be set to a right angle by adjusting the hydraulic cylinders 50A-50D such that, as shown in FIG. 6, the conveying surface is extended horizontally and the level of the conveying surface is equal to that of the rotation center O.

Thus, inclining the conveying surface of the feed conveyor 12 also makes it possible to change the relative positional relationship between the crushing rotor 32 and the feed conveyor 12, and to adjust the crushing angle θ. Accordingly, advantages can also be obtained which are similar to those obtained in the case of changing the height of the conveying surface of the feed conveyor 12 and adjusting the crushing angle. Further, the method of inclining the conveying surface for adjustment of the crushing angle can be alternatively practiced by providing a pair of hydraulic cylinders, which support the drive or driven shaft, on at least one of the drive wheel 26 side and the driven wheel 27 side of the feed conveyor 12 so that the feed conveyor 12 is inclined by the pair of hydraulic cylinders. Hence the method of inclining the conveying surface can be realized with a simpler construction than the method of changing the height of the conveying surface as described in above (1).

While the method of inclining the conveying surface has been described in above (2) as using the hydraulic cylinders 50A-50D disposed at four corners of the feed conveyor 12, the inclining manner is not limited to the described one. An alternative inclining manner can be practiced, for example, by providing a pivotal point at an appropriate position of the feed conveyor such that the feed conveyor is angularly pivoted about the pivot point to incline in the longitudinal direction of the feed conveyor, and providing posture holding means for holding the posture of the feed conveyor inclined by pivotal motion. In such a case, the conveying surface can be inclined by inclining the feed conveyor about the pivotal point and holding the inclined posture of the feed conveyor by the posture holding means.

Further, while the above cases (1) and (2) have been described, by way of example, as changing the height of the conveying surface relative to the crushing rotor and adjusting the crushing angle with the manual operation, the manner of adjusting the crushing angle is not limited to the described one. An alternative adjusting manner can be practiced, for example, by previously registering the respective amounts of extension or retraction of the hydraulic cylinders 50A-50D corresponding to the crushing angle in, e.g., a control unit for executing the operation, control, etc. of the crusher, and by controlling the amounts of extension or retraction of the hydraulic cylinders 50A-50D through the control unit, etc. in accordance with the desired angle inputted from the operator through the console, etc., thus performing automatic adjustment of the crushing angle.

Advantages of this embodiment will be described below.

In the known crusher, because the positional relationship between the feed conveyor and the crushing rotor is held fixed, the crushing bits provided on the crushing rotor always cut the target materials introduced to the crushing apparatus substantially at a constant angle for crushing them, and the crushing angle at which the target materials are cut cannot be changed depending on needs. Therefore, when crushed chips having a relatively smaller grain size than those usually produced are to be produced, the crushing work has to be continued until the target materials are crushed into the desired grain size within the crushing chamber, thus resulting in reduction of throughput per unit time. Conversely, when importance is paid to the throughput of the crushed chips, it is hard to increase the throughput of the crushed chips per unit time by using a single crusher, thus resulting in difficulty in increasing the work efficiency. Thus, the known crusher is disadvantageous in that, when attempting to produce finer chips or a larger amount of chips by using a single crusher, the working time is prolonged and the work efficiency is deteriorated correspondingly.

In contrast, according to the embodiment of the present invention, since the heights of the drive wheel 26 and the driven wheel 27 of the feed conveyor 12 are adjustable by extending and retracting the hydraulic cylinders 50A-50D through the predetermined operation, the posture of the feed conveyor 12 can be changed with respect to the hopper 11 and the crushing apparatus 13 held in fixed relation to the hopper 11, or the feed conveyor 12 can be translated up and down while keeping the posture. Therefore, the crushing angle can be adjusted by changing the relative positional relationship between the feed conveyor 12 and the crushing apparatus 13, as required, in consideration of the desired crushing efficiency, the desired grain size of the crushed chips, etc. Hence the present invention can provide a crusher which has the multiple functions by a single machine and is capable of producing the crushed chips in a way flexibly adapted for various needs caused in sites.

Also, according to the crusher of the embodiment, since the target materials gripped between the feed conveyor 12 and the pressing roller 17 are cut by the crushing rotor 32, an especially significant advantage is obtained when the target materials are so long as enabling the feed conveyor 12 or the pressing roller 17 to positively receive crushing reaction forces.

While the embodiment has been described above in connection with the case where the rotating direction of the crushing rotor 32 is set to cut the target materials from below (upward cutting), the present invention is of course also applicable to the case where the rotating direction of the crushing rotor 32 is set reversed to cut the target materials from above (downward cutting).

While the above description has been made of the methods of changing the crushing angle by changing the level position and the inclination of the conveying surface of the feed conveyor 12, the crushing angle is adjustable and the advantages of the present invention are obtained if the relative positional relationship between the crushing apparatus 13 and the feed conveyor 12 can be changed in any way. In other words, similar advantages to those in the embodiment can also be obtained by using, instead of the method of changing the position or posture of the feed conveyor 12 with respect to the center of rotation of the crushing rotor 32, a method of vertically changing the position of the crushing rotor 32 with respect to the feed conveyor 12, a method of vertically moving the inclined conveying surface in combination of the position change and the inclination change, or other suitable method, because the relative positional relationship between the crushing apparatus 13 and the feed conveyor 12 can also be changed so as to adjust the crushing angle by such a method. Further, similar advantages to those in the embodiment can be obtained by using, instead of the hydraulic cylinders 50A-50D provided as posture control means for the feed conveyor, hydraulic jacks, screw members, etc. as the posture control means to adjust the crushing angle.

While the above description has been made, by way of example, in connection with the case where the present invention is applied to a self-propelled crusher, the present invention is not limited to such an application and can be of course applied to a movable crusher capable of traveling by traction, a transportable crusher capable of being lifted by, e.g., a crane and transported, and a stationary crusher installed as a fixed machine in a plant or the like. In addition, the crusher is able to crush various target materials, such as wood, waste plastics, waste straw matting (tatami), and bamboos, and it can provide the above-described advantages regardless of the kinds of the target materials.

According to the present invention, since the angle at which the crushing bit cuts into the target materials is adjustable, crushed chips can be produced in a way flexibly adapted for various needs caused in sites by using a single crusher.

What is claimed is:

1. A crusher comprising:

a crushing apparatus including a crushing rotor provided with a crushing bit for crushing target materials;

a feed conveyor for conveying the target materials to said crushing apparatus;

a pressing roller for pressing the target materials conveyed on said feed conveyor and introducing the target materials to said crushing apparatus directly by gripping the target materials with said feed conveyor;

means for changing a relative positional relationship between said crushing apparatus and a conveying surface of said feed conveyor, to thereby change a crushing angle (θ) formed between a feed direction (X) of the target materials when the target materials are introduced to said crushing apparatus and a line (Y) tangential to said crushing rotor at a position where said crushing bit hits against the target materials; and wherein said crushing angle is varied among an acute angle, right angle and obtuse angle by said means for changing the relative positional relationship between the crushing apparatus and the feed conveyor.

2. The crusher of claim 1, wherein said means for changing the relative positional relationship between said crushing apparatus and said feed conveyor is feed-conveyor height adjusting means for vertically moving said feed conveyor up and down.

3. The crusher of claim 2, wherein said feed-conveyor height adjusting means includes a plurality of cylinders disposed laterally of outer walls of a hopper, into which are loaded the target materials, and supporting bearings of a drive wheel and a driven wheel in a vertically movable manner independently of one another, said drive wheel and said driven wheel being disposed at opposite ends of said feed conveyor in the feed direction of the target materials.

4. The crusher of claim 1, wherein said means for changing the relative positional relationship between said crushing apparatus and said feed conveyor is feed-conveyor inclination angle adjusting means for changing a level position of at least one of opposite ends of said feed conveyor in the feed direction of the target materials, thereby adjusting an inclination angle of said feed conveyor.

5. The crusher of claim 4, wherein said feed-conveyor inclination angle adjusting means includes a plurality of cylinders disposed laterally of outer walls of a hopper, into which are loaded the target materials, and supporting bearings of a drive wheel and a driven wheel in a vertically movable manner independently of one another, said drive wheel and said driven wheel being disposed at opposite ends of said feed conveyor in the feed direction of the target materials.

* * * * *